US007867150B2

(12) United States Patent
Wang

(10) Patent No.: US 7,867,150 B2
(45) Date of Patent: Jan. 11, 2011

(54) RESISTANCE APPARATUS OF A PENDULUM MECHANISM OF AN EXERCISE EQUIPMENT

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 12/352,600

(22) Filed: Jan. 12, 2009

(65) Prior Publication Data

US 2010/0179036 A1 Jul. 15, 2010

(51) Int. Cl.
*A63B 21/008* (2006.01)
*A63B 22/14* (2006.01)

(52) U.S. Cl. ..... 482/112; 482/146

(58) Field of Classification Search ..... 482/111–113, 482/146–147, 51

See application file for complete search history.

(56) References Cited

U.S. PATENT DOCUMENTS 4,575,076 A * 3/1986 Reichert et al. ..... 273/453
5,632,711 A * 5/1997 Hwang ..... 482/147
6,113,522 A * 9/2000 Fontenot et al. ..... 482/111
6,899,657 B2 * 5/2005 Chuang ..... 482/52

* cited by examiner

*Primary Examiner*—Fenn C Mathew

(57) ABSTRACT

A resistance apparatus of a pendulum mechanism of an exercise equipment, wherein the pendulum of the pendulum mechanism creates an expected coupled swing action responsive to the reciprocating movement done by a certain exercise equipment when subject to the action of a force, thereby providing a proper inertia movement and a gravity load action. A resistance adjuster having a telescopic rod is pivotally coupled between the pendulum and the base frame of the exercise equipment for providing a proper exercise resistance.

6 Claims, 4 Drawing Sheets

RESISTANCE APPARATUS OF A PENDULUM MECHANISM OF AN EXERCISE EQUIPMENT

BACKGROUND OF THE INVENTION

1. Fields of the Invention

The invention relates to a resistance apparatus of a pendulum mechanism of an exercise equipment, and more particularly, to a structure for providing a proper exercise resistance.

2. Description of the Related Art

Previously, the applicant of the invention has disclosed a new pendulum type coupling mechanism for certain exercise apparatuses (such as waist-twisting exerciser, an elliptical cross trainer, etc.) having different kinds of the reciprocating movement to replace the inertia flywheel type structure for meeting the exercise requirement of the operators in a better way and for effectively avoiding the exercise injuries. The patent of the above-mentioned structure is still pending (see U.S. patent application Ser. No. 12/177,150) so that no further descriptions thereto are given hereinafter. The invention is an extended structure relative to the pendulum type coupling mechanism previously developed.

SUMMARY OF THE INVENTION

A first object of the invention is to provide a resistance apparatus of a pendulum mechanism of an exercise equipment wherein a resistance adjuster having a telescopic rod is pivotally coupled between the pendulum of the pendulum mechanism and the base frame for providing a proper exercise resistance. In this way, the exercise effect is enhanced.

According to the invention, the resistance apparatus includes a resistance adjuster interposed between the pendulum and the base frame. The resistance adjuster includes an adjustable pneumatic cylinder or an adjustable hydraulic cylinder for providing a proper exercise resistance when the pendulum swings by the action of a force.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
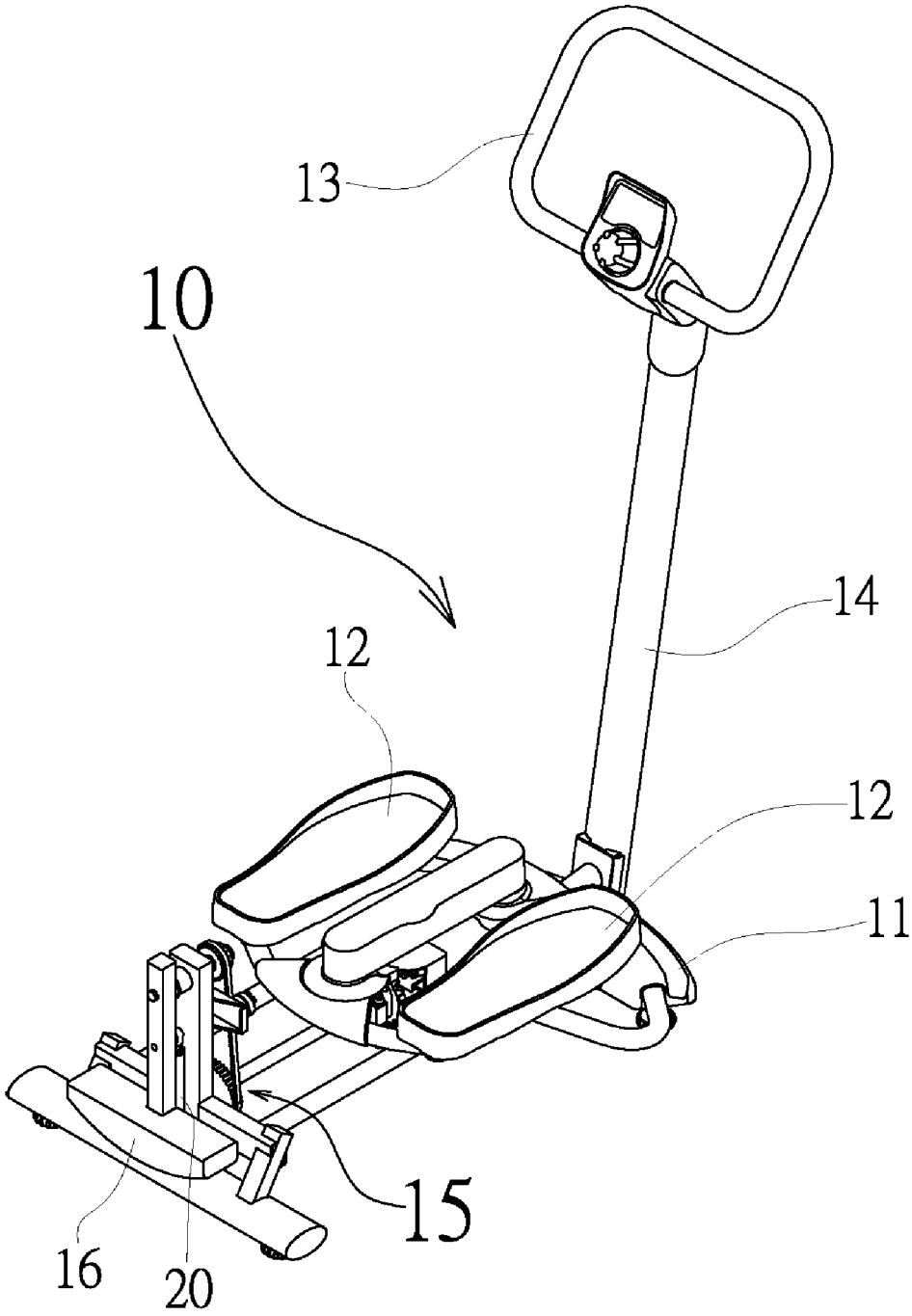
FIG. 1 is a perspective view of a preferred embodiment of the invention.
Figure 2:
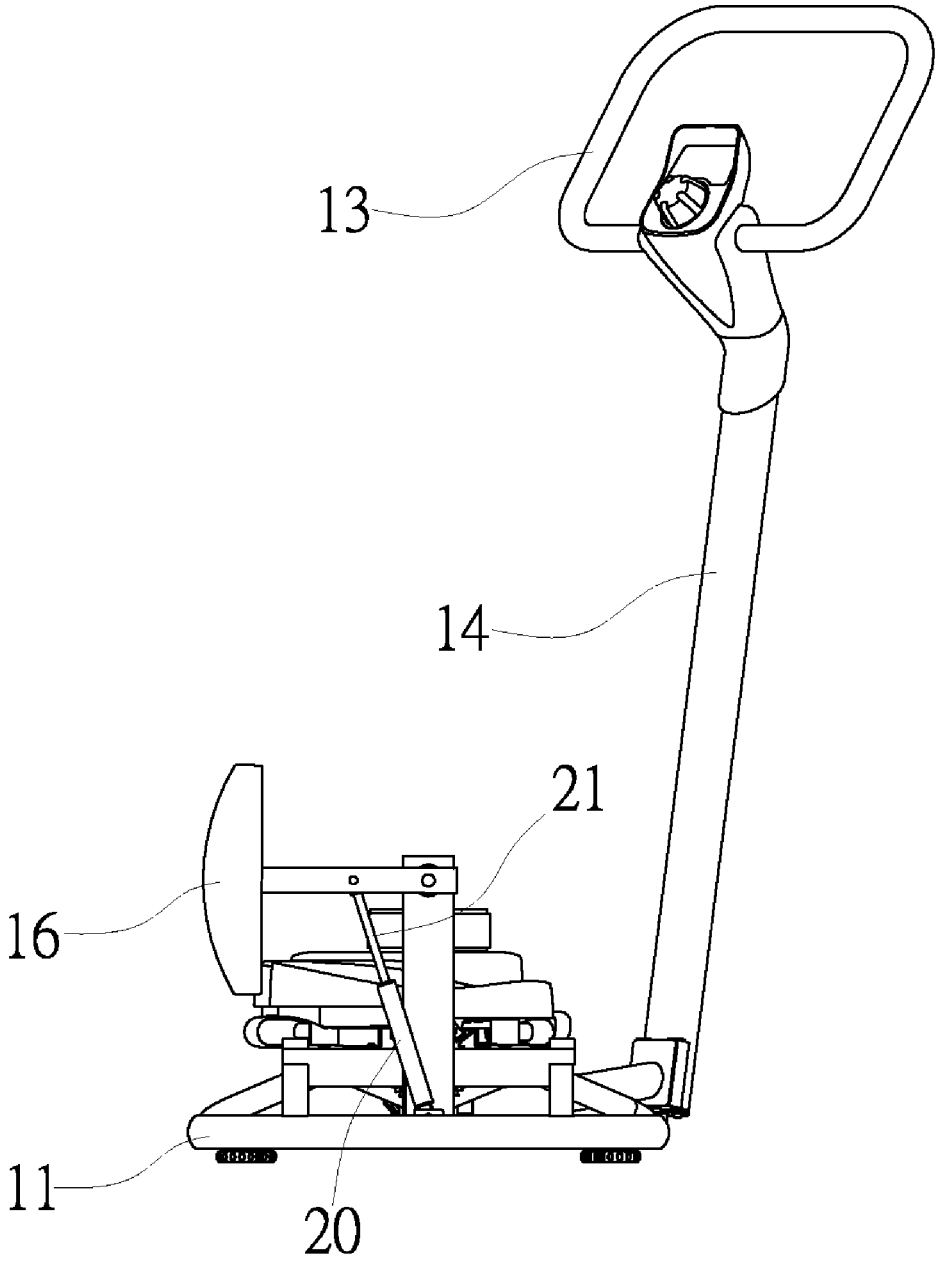
FIG. 2 is a side view of the embodiment of the invention according to FIG. 1, showing the operation thereof.

As shown in FIGS. 1 and 2, a resistance apparatus of a pendulum mechanism of an exercise equipment is applied to a waist-twisting exerciser 10. The waist-twisting exerciser 10 includes a base frame 11, a pair of swivel pedals 12, and a handrail frame 14 with a handle 13. A pendulum mechanism 15 is coupled at the back of the swivel pedals 12. Besides, a resistance adjuster 20 having a telescopic rod 21 is pivotally coupled between the pendulum 16 of the pendulum mechanism and the base frame 11 for providing a proper exercise resistance. In this way, the exercise effect is enhanced.

The resistance adjuster 20 includes an adjustable pneumatic cylinder or an adjustable hydraulic cylinder.

Figure 3:
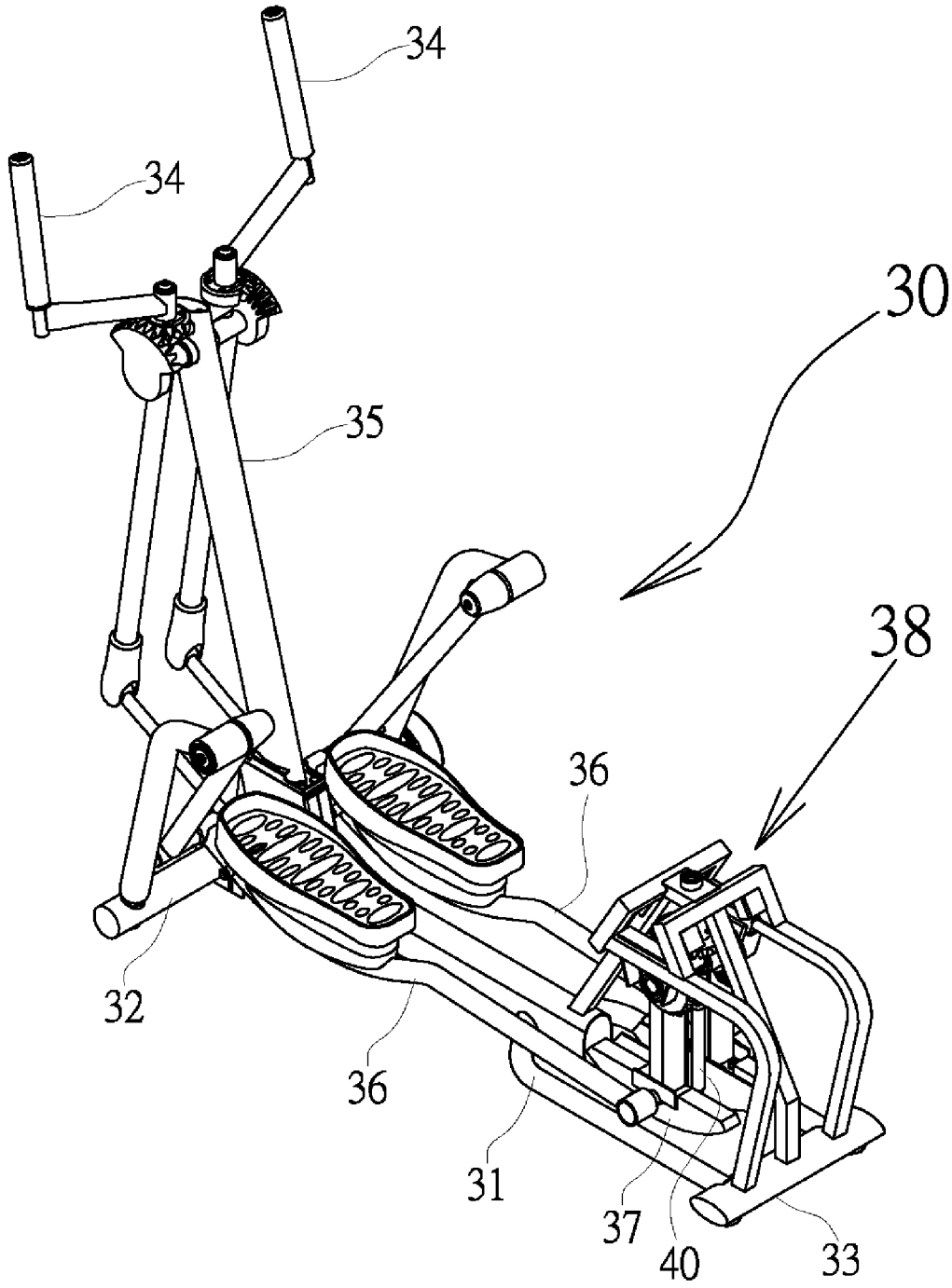
FIG. 3 is a perspective view of another embodiment of the invention.
Figure 4:
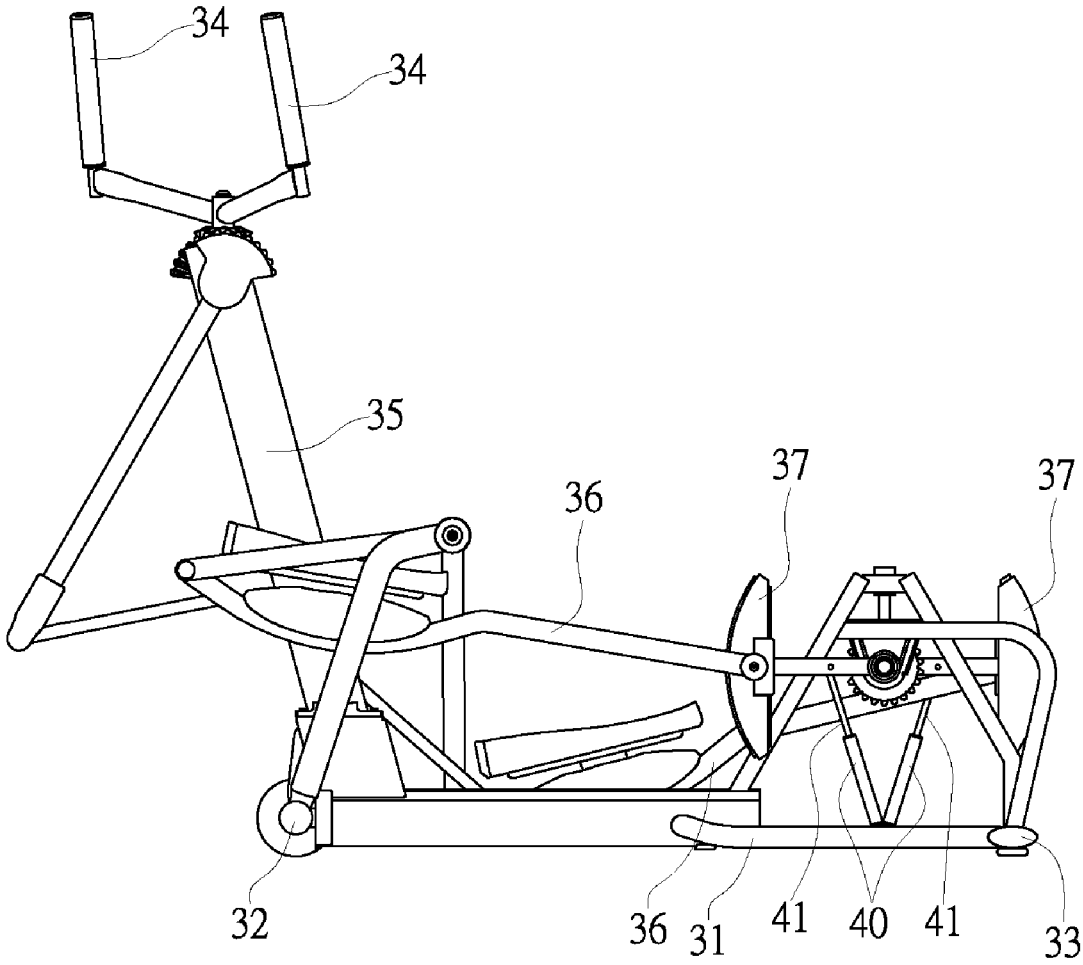
FIG. 4 is a side view of the embodiment of the invention according to FIG. 3, showing the operation thereof.

Likewise, as shown in FIGS. 3 and 4, a resistance apparatus of a pendulum mechanism of an exercise equipment in accordance with the invention is applied to an elliptical cross trainer 30. The elliptical cross trainer 30 includes a base frame 31, a front ground-touching rod 32, a rear ground-touching rod 33, a front support 35 with two handles 34, two pedal-connecting rods 36, and a pendulum mechanism 38 having two pendulums 37 and coupled with the pedal-connecting rods 36. Similarly, a resistance adjuster 40 having a telescopic rod 41 is pivotally coupled between the pendulums 37 of the pendulum mechanism 38 and the base frame 31 for providing the same effect.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A resistance apparatus of an exercise equipment, comprising:

a base frame, a pendulum mechanism, and a pair of swivel pedals;

wherein the pendulum of the pendulum mechanism travels in an arcuate path to create an expected coupled swing action responsive to the reciprocating movement when subject to the action of a force applied to the swivel pedals of the exercise equipment, thereby providing an inertia movement and a gravity load action gives a resistance effect of an exercise load due to a weight of the pendulum; and wherein a resistance adjuster having a telescopic rod is pivotally coupled between the pendulum and the base frame of the exercise equipment for providing an exercise resistance to the swing action of the pendulum due to the weight of the pendulum as the pendulum travels along the arcuate path.

2. The resistance apparatus of a pendulum mechanism of an exercise equipment as recited in claim 1, wherein the resistance adjuster includes an adjustable pneumatic cylinder.

3. The resistance apparatus of a pendulum mechanism of an exercise equipment as recited in claim 1, wherein the resistance adjuster includes an adjustable hydraulic cylinder.

4. A resistance apparatus of a waist-twisting exerciser, the waist-twisting exerciser comprising:

a base frame, a pair of swivel pedals, a pendulum mechanism, and a handrail frame with a handle, wherein the pendulum mechanism is coupled at the back of the swivel pedals and a pendulum of the pendulum mechanism travels in an arcuate path when force is applied to the swivel pedals; and wherein a resistance adjuster having a telescopic rod is pivotally coupled between the pendulum of the pendulum mechanism and the base frame for providing an exercise resistance to the swing action of the pendulum due to a weight of the pendulum as the pendulum travels along the arcuate path.

5. The resistance apparatus of a pendulum mechanism of an exercise equipment as recited in claim 4, wherein the resistance adjuster includes an adjustable pneumatic cylinder.

6. The resistance apparatus of a pendulum mechanism of an exercise equipment as recited in claim 4, wherein the resistance adjuster includes an adjustable hydraulic cylinder.

* * * * *